United States Patent [19]

Juang

[11] Patent Number: 4,752,074

[45] Date of Patent: Jun. 21, 1988

[54] PUZZLE GAME

[76] Inventor: Shih-Hung Juang, 10F-8, No. 103, Sec. 1, Fuhsing S. Rd., Taipei, Taiwan

[21] Appl. No.: 911,505

[22] Filed: Sep. 25, 1986

[51] Int. Cl.[4] ..... A63F 9/08

[52] U.S. Cl. ..... 273/153 R; 273/155

[58] Field of Search ..... 273/155, 153 R

[56] References Cited

U.S. PATENT DOCUMENTS

| | | | |
|---|---|---|---|
| 3,128,100 | 4/1964 | Sinden | 273/155 X |
| 4,560,164 | 12/1985 | Darling | 273/155 |
| 4,632,399 | 12/1986 | Bern | 273/155 |

FOREIGN PATENT DOCUMENTS

| | | | |
|---|---|---|---|
| 13633 | of 1899 | United Kingdom | 273/155 |
| 1178458 | 9/1985 | U.S.S.R. | 273/155 |

*Primary Examiner*—Anton O. Oechsle

*Attorney, Agent, or Firm*—Steinberg & Raskin

[57] ABSTRACT

A game wheel comprising a support base, a plurality of identical rollers radially arranged and rotatably resting on the support base, and an observation wheel with observation slots. The surface of each roller is divided into several regions marked with different digits, letters or colors, respectively. The observation wheel is provided with several one-way turning protrusions on the bottom face so as to turn the rollers contacting the protrusions when the observation wheel is turned in a clockwise (CW) direction. Conversely, counterclockwise (CCW) rotation of the observation wheel will not turn the rollers. Indicating marks set on the upper face of the observation wheel indicate the positions of the turning protrusions. By CW and CCW rotation of the observation wheel, a user may arrange the randomly arrayed digits, letters or colors of the rollers into a uniform or predetermined pattern.

9 Claims, 6 Drawing Sheets

PUZZLE GAME

BACKGROUND OF THE INVENTION

The present invention relates to a puzzle game wheel which comprises a support base, a plurality of identical rollers disposed upon the support base, and an observation wheel covering the rollers and the support base. The surface of each roller is evenly divided into several regions on which different digits, letters or colors are marked. The bottom face of the observation wheel is set with a few turning protrusions which turn the rollers contacting the protrusions when the observation wheel is turned in a (CW) direction. Conversely, counterclockwise (CCW) rotation of the observation wheel does not turn the rollers. By CW and CCW rotation of the observation wheel, the randomly-arrayed digits, letters or colors of the rollers may be turned to some pre-determined uniform pattern.

In recent years, there have been a great deal of game articles available in the market for exercising the user's intelligence and at the same time providing users with enjoyment and entertainment. One very successful and world-renowned intelligence game article is Rubik's Cube®. However, most other intelligence game articles fail to become world-famous and have only short commercial lifespans. This is largely due to the fact that intelligence game articles have complicated structures and intricate operation rules. Complicated structures raise the cost of the intelligence game articles. Intricate operation rules often perplex new users. Therefore, the present invention, a puzzle game wheel, is designed from simple elements and is played with simple rules.

SUMMARY OF THE INVENTION

A primary object of the present invention is to mitigate and/or obviate the aforedescribed drawbacks of prior intelligence game articles.

Another object of the present invention is to provide a puzzle game wheel which has a relatively simple structure as well as simple and easy-to-understand operation rules.

A further object of the present invention is to provide a puzzle game wheel wherein the numbers of the rollers and the turning protrusions, the shape of the polygonal rolling blocks, and the styles of marking the evenly-divided regions of the surface of each roller are not exclusive and can be optionally determined.

Further objects and advantages of the present invention will become apparent as the following description proceeds, and the features of novelty which characterize the invention are pointed out with particularity below.

DETAILED DESCRIPTION OF THE PREFERRED EMBODIMENT

Figure 1:
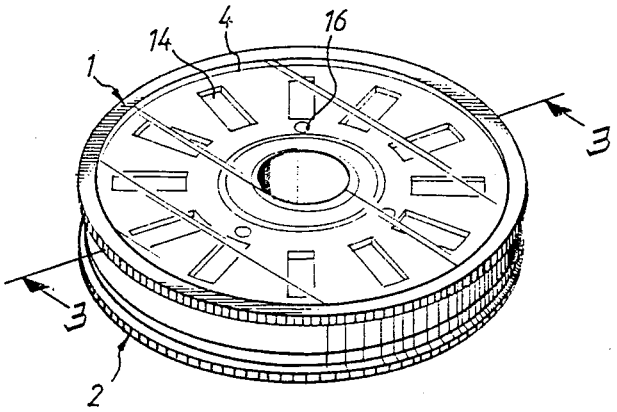
FIG. 1 is a perspective view of an embodiment of a puzzle game wheel according to the present invention.
Figure 2:
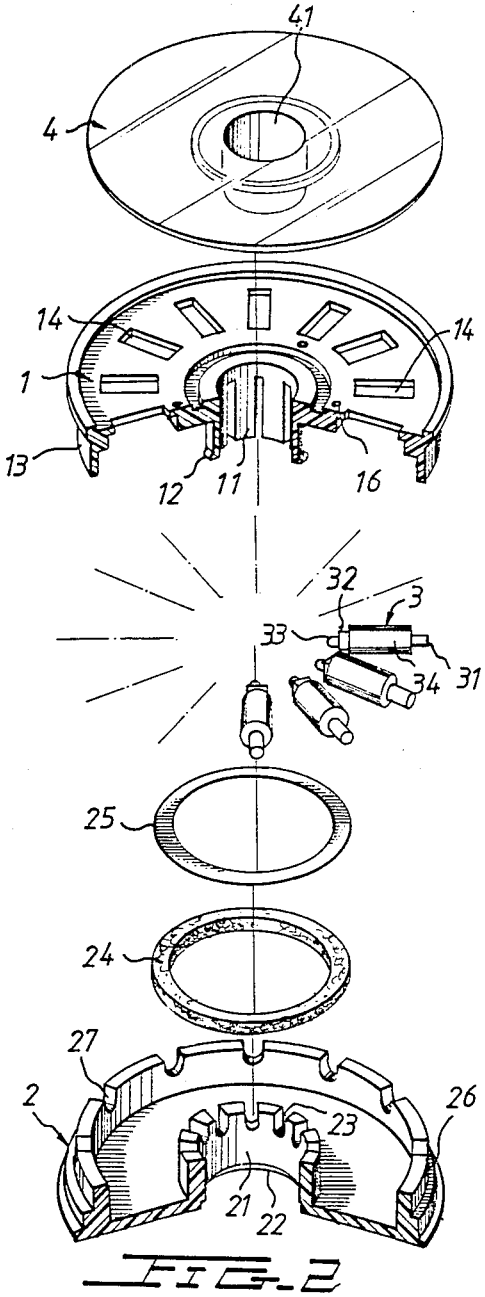
FIG. 2 is an exploded view of the puzzle game wheel of the present invention.
Figure 3:
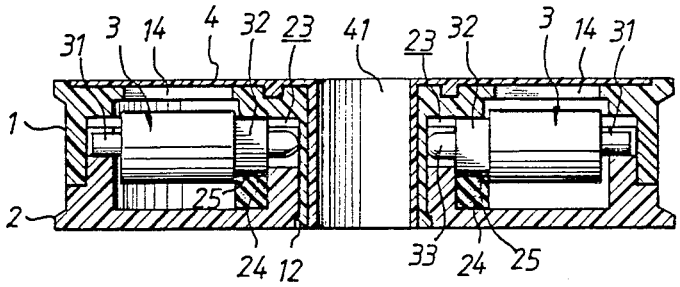
FIG. 3 is a cross-sectional view of the puzzle game wheel as shown in FIG. 1.

Referring to the drawings, particularly to FIGS. 1, 2 and 3, it can be seen that the preferred embodiment of the puzzle game wheel according to the present invention comprises a support base 2, a spongy ring 24 and a protective ring 25, disposed in the support base 2, twelve identical rollers 3 disposed on the rings 24 and 25, and an observation wheel 1 covering all the above-mentioned elements.

The shape of the support base 2 is somewhat similar to the shape of an ashtray. The center of the support base 2 is set with a base hub 21 whose top edge is evenly set with twelve radial knob recesses 23. A circular engagement notch 22 is provided beneath the base hub 21. Twelve evenly-spaced post recesses 27 are radially set on the top edge of the circumferential support rim 26 of the support base 2. The number of the knob recesses 23 is always the same as that of the post recesses 27 and each knob recess 23 is aligned with one of the post recesses 27. The elastic spongy ring 24 whose inner diameter is substantially equal to or slightly larger than the outer diameter of the base hub 21 is disposed around the base hub 21. The protective ring 25 with a shape corresponding to the spongy ring 24, is fixed to the spongy ring 24. Because the protective ring 25 is made of a flexible and tough material, it prevents the spongy ring 24 from being damaged by the sharp articles.

Twelve rollers 3 rest on support base 2 as illustrated. The number of rollers 3 is identical to that of the knob recesses 23 or the post recesses 27 i.e. twelve. The twelve rollers are all identical in shape. Each roller comprises a cylindrical part 34. A post 31 is set on the same end of the cylindrical part 34 of each cylindrical roller 3 for resting on the post recess 27 of the support base 2. The other end of each cylindrical part 34 has a square rolling block 32 which rests on the protective ring 25 and the spongy ring 24 (see FIG. 3). The length of the sides of the square rolling block 32 is slightly larger than the width of the protective ring 25. The outer end of the square rolling block 32 opposite to the post 31 is further set with a round-headed knob 33 for resting on the knob recess 23 aligned with the just-mentioned post recess 27 when the rolling block 32 is pressed downwards. The surface of the cylindrical part 34 of each roller 3 is evenly divided into four regions, each of which is respectively marked with one particular digit, letter, or color. The surface of the cylindrical part 34 of each roller 3 is marked identical to the others. The number of the divided regions of the surface of the cylindrical part 34 of the roller 3 is always identical with the number of the sides of the polygonal rolling block 32.

The observation wheel 1 is provided with a flexible slitted hub 11 on the center thereof, a circumferential rim 13 on the outer edge thereof, and twelve evenly spaced observation slots 14 on the upper face thereof around the slitted hub 11. The outer diameter of the slitted hub 11 is substantially the same as or slightly less than the inner diameter of the base hub 21 of the support base 2. The lower end of the slitted hub 11 is set with outward engagement protuberances 12 for engaging with the engagement notch 22 beneath the base hub 21. Therefore, the observation wheel 1 can be secured to the support base 2 by engaging the flexible slitted hub 11 of the observation wheel 1 to the base hub 21 of the support base 2. The inner diameter of the circumferential rim 13 of the observation wheel 1 is slightly larger than the outer diameter of the circumferential support rim 26 so as to enable the rim 13 of the observation wheel 1 to fit on the support rim 26 of the support base 2. The evenly spaced observation slots 14 are arranged so that they may be moved to be located directly above all the twelve rollers 3 by turning the observation wheel 1. Three identical turning protrusions 15 (see FIGS. 4–9), each having a parabolic spandrel cross-section, are provided on the bottom face of the observation wheel 1 at irregular intervals. Each turning protrusion 15 is located between the inner end of an observation slot 14 and the slitted hub 11. Three indicating markes 16 are set on the upper face of the observation wheel 1 and above the protrusions 15 for indicating the positions of the turning protrusions 15. Because the slitted hub 11 is flexible, the observation wheel 1 could become detached from the support base 2 if the observation wheel 1 is unintentionally pulled upwards somewhat heavily. To avoid this problem, a transparent securing cover 4 comprising a central securing hub 41 is disposed on the observation wheel 1 with the securing hub 41 inserting into the slitted hub 11 to prevent the slitted hub 11 from being inwardly deformed and consequently becoming detached from the base hub 21. The outer diameter of the securing hub 41 of the securing cover 4 is substantially equal to or slightly less than the inner diameter of the slitted hub 11. The securing cover 4 can be attached to the observation wheel 1 by adhesion or any other appropriate means.

Figure 4:
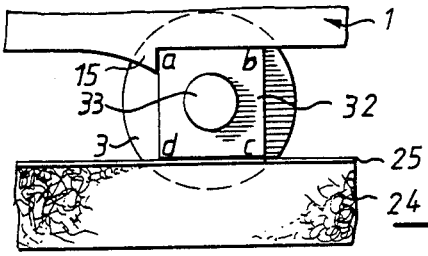
FIG. 4 shows the front end of one turning protrusion of the observation wheel as it comes into contact with face a-d of the rolling block of a roller.
Figure 5:
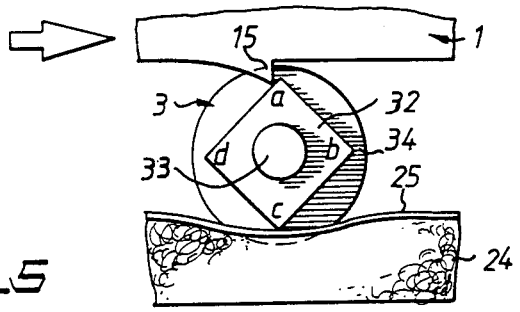
FIG. 5 shows the rolling block shown in FIG. 4 is being turned by the turning protrusion as the observation wheel is turned in the direction of the arrow.
Figure 6:
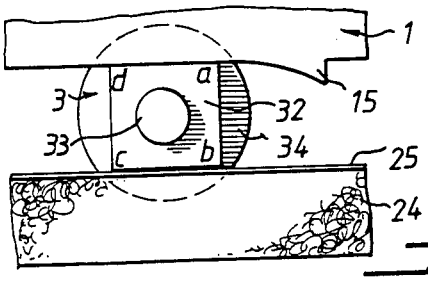
FIG. 6 shows the condition in which face a-d of the rolling block of a roller has been turned to face upwards.

Referring to FIGS. 4–9, the progressive positions of the turning protrusion 15 rolling over the square rolling block 32 can be clearly seen. FIG. 4 shows the front end of one turning protrusion 15 of the observation wheel 1 is turned to come in contact with face a-d of the rolling block 32 of one roller 3. It should be noted that there are always two other turning protrusions 15 in the same working conditions against two other corresponding rolling blocks 32 as the present-described turning protrusion 15 shown in FIG. 4–9. When the observation wheel 1 is further turned in the clockwise direction, as shown in FIG. 5 (the CW direction is represented by the arrow on this figure), the front end of the turning protrusion 15 will simultaneously press downwardly and turn forwardly the rolling block 32 of the roller 3. The above-described movements of the rolling block 32, which is turned in a CW direction by the turning protrusion 15, are a result of external force against the square rolling block 32 acting in the form of rotational torque with the axis of the roller being the torque axis. Because the observation wheel 1 can not be lifted up, the rolling block 32 is thus going to be pushed downwardly and subsequently the rolling block 32 may be turned. FIG. 6 shows the rolling block 32 having been turned over one side by the turning protrusion 15 in CW movement. Face a-d of the rolling block 32, which originally faced to the left, has already been turned to face upwardly. At the same time the rolling block 32 (shown in FIG. 6) is being turned over one side, the other two rolling blocks 32 which contact with other two turning protrusions 15 have also been turned over one side. It is noted that other nine rollers 3 whose square rolling blocks 32 do not contact the turning protrusions 15 do not rotate during the period of the above-mentioned three rollers 3 are being turned.

Figure 7:
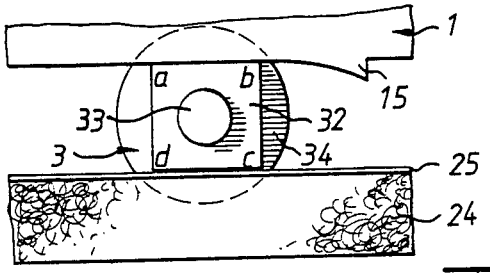
FIG. 7 shows the rear end of the turning protrusion of the observation wheel as it is about to come in contact with face b-c of the rolling block of a roller.
Figure 8:
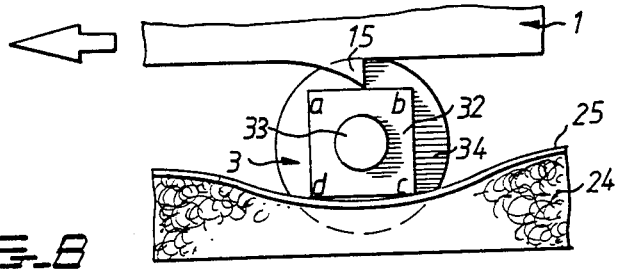
FIG. 8 shows the rolling block as it is being pressed downwards without rotation by the turning protrusion when the observation wheel is turned in the direction of the arrow, which is opposite to the direction of the arrow shown in FIG. 5.
Figure 9:
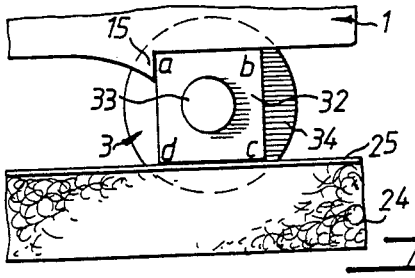
FIG. 9 shows the condition that face b-c of the rolling block still faces to right after the turning protrusion of the observation wheel has rolled over the rolling block.

Referring to FIGS. 7–9, the counterclockwise rotation of the observation wheel acting on the rollers 3 can be seen. FIG. 7 shows that the rear end of the tuning protrusion 15 is about to contact the top edge of face b-c of one of the rolling blocks 32. Because the gradient of the rear portion of the turning protrusion 15 is very low, the external force exerted on the rolling block 32 is primarily exerted as a vertically downward stress when the tuning protrusion 15 having a parabolic spandrel cross-section is turned CCW to further contact the rolling block 32. FIG. 8 shows the rolling block 32 being pressed down by the lower edge of the turning protrusion 15 when the turning protrusion is turned in a CCW direction (as indicated by the arrow in FIG. 8) against face a-b of the rolling block 32. FIG. 9 shows the instant after the turning protrusion 15 has rolled over the rolling block 32 and the rolling block 32 whose b-c face is still facing right and does not rotate during the above-described CCW rotation of the turning protrusion 15.

From the description hereinbefore, it can be understood that when the observtion wheel 1 is turned in a CW direction, the three rollers 3 which are positioned directly under the three indicating marks 16 will be turned CW 90 degrees. The CCW rotation of the observation wheel 1 does not cause any corresponding turning of the rollers 3, whether or not the rollers 3 are directly under the indicating marks 16.

Generally speaking, the object of the puzzle game wheel is to turn the rollers, which are randomly set, so that they show some particular uniform and/or predetermined pattern by CW and CCW rotations of the observation wheel 1. Since the arrangement of the three turning protrusions 15 is not evenly-spaced or symmetrical and the number of the rollers 3, which are turned CW 90 degrees by the rotation of the observation wheel 1 at any one time is plural, the process of trying to turn the randomly set rollers 3 into uniformly patterned rollers 3 is challenging and full of fun. Consequently, the present puzzle game wheels provides users with a lot of intellectual exercise and provides a great deal of enjoyment.

Figure 10:
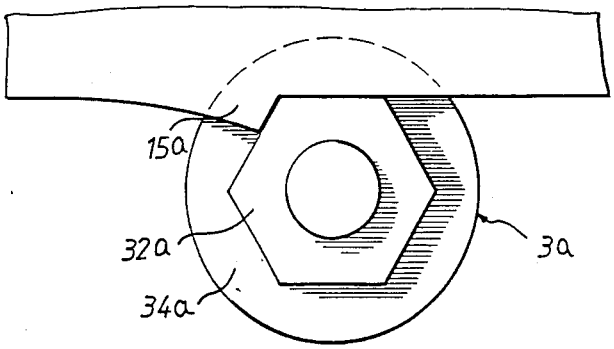
FIG. 10 shows another embodiment of the present invention wherein the polygonal rolling block is hexagonal and the cross-sectional shape of the turning protrusion is set in accordance with the hexagonal rolling block.

The number of rollers 3, observation slots 14, and knob and post recesses, 23 and 27, are equal, since these parts are mutually dependent. It is noted that this number is not necessarily limited to twelve, which is merely adopted as a preferred embodiment of the present invention. In addition, the numbers of the sides of the polygonal rolling block 32 of each roller 3 and evenly-divided regions of the surface of the cylindrical part 34 of each roller 3 (to be marked with digits, letters, or colors, respectively) are not necessarily limited to four. This number was merely adopted as a preferred embodiment of the present invention. Once the polygonal rolling block is determined, a corresponding turning protrusion is adopted to enable CW turning of the contacted roller and CCW rolling over the contacted roller without any turning. Referring to FIG. 10, another possible embodiment of a turning protrusion 15*a* and a hexagonal rolling block 32*a* can be clearly seen. In this embodiment, the surface of the cylindrical part 34*a* of each roller 3*a* is accordingly divided into six even regions on which different digits, letters, or colors are respectively marked.

It is noted that as various possible embodiments may be made of the above invention, and as various adaptations might be made in the embodiment above set forth, it is to be understood that all matter herein described or shown in the accompanying drawing is to be interpreted as illustrative and not in a limiting sense. Thus it will be appreciated that the drawings are exemplary of a preferrd embodiment of the invention.

I claim:

1. A puzzle game comprising:

(a) a support base including a central base hub and a circumferential support rim; a circular engagement notch being provided beneath said central base hub, a plurality of post recesses being evenly spaced on a top edge of said circumferential support rim and a plurality of knob recesses being evenly spaced on a top edge of said central base hub and respectively aligned with said post recesses;

(b) a spongy ring and a protective ring which are disposed around said base hub, with said protective ring disposed upon said spongy ring;

(c) a plurality of identical rollers; each of said identical rollers comprising a cylindrical part, a post set on one end of each cylindrical part, and a polygonal rolling block set on the other end of each cylindrical part; the end of said polygonal rolling block opposite to said post being set with a round-headed knob; the surface of each cylindrical part being evenly divided into regions which are respectively marked with different digits, letters or colors; said rollers being disposed on said support base with the post of each roller disposed upon one of said post recesses, said round-headed knob of each roller disposed upon one of said knob recesses, and said polygonal rolling block of each roller resting on said protective ring;

(d) an observation wheel including a central slitted hub and a circumferential rim; a plurality of evenly spaced observation slots being set on an upper face of said observation wheel and arranged to be located directly above all said rollers by turning said observation wheel; a lower end of said slitted hub being set with outward engagement protuberances for engaging said circular engagement notch of said support base; a plurality of turning protrusions with parabolic spandrel cross-sections being provided on a bottom face of said observation wheel, each of said turning protrusions being located between an inner end of one of said observation slots and said slitted hub and corresponding to a location of one of said polygonal rolling blocks when said wheel is turned; a plurality of indicating marks being set on the upper face of said observation wheel and above said turning protrusions; and (e) a transparent securing cover including a central securing hub having an outer diameter substantially equal to or slightly less than an inner diameter of said slitted hub.

2. A puzzle game as set forth in claim 1, wherein the number of said rollers, said observation slots, said knob recesses and said post recesses are equal.

3. A puzzle game as set forth in claim 1, wherein the rolling block of each roller is square.

4. A puzzle game wheel as set forth in claim 1, wherein the number of the turning protrusions is three.

5. The game of claim 1, comprising several of said post recesses, said knob recesses, said rollers, and said observation slots.

6. The game of claim 5, comprising twelve of said post recesses, said knob recesses, said rollers, and said observation slots.

7. The game of claim 3, wherein each cylindrical part of each roller is divided into four regions.

8. The game of claim 1, wherein said turning protrusions are each positioned to contact said polygonal rolling blocks when said wheel is turned.

9. The game of claim 1, wherein said turning protrusions are positioned to turn said rolling blocks when said wheel is rotated in one direction, and not turn said rolling blocks when said wheel is rotated in an opposite direction.

* * * * *